United States Patent [19]

Marczewski

[11] Patent Number: 4,466,612

[45] Date of Patent: Aug. 21, 1984

[54] ADJUSTABLE RESISTANCE EXERCISING DEVICE

[76] Inventor: George B. Marczewski, 739 Oakwood Dr., Westmont, Ill. 60559

[21] Appl. No.: 321,594

[22] Filed: Nov. 16, 1981

[51] Int. Cl.[3] ..... A63B 21/00

[52] U.S. Cl. ..... 272/133; 272/126; 188/65.1; 182/6

[58] Field of Search ..... 272/133, 143, 131, 126; 188/65.1, 65.4, 65.2; 182/6, 7, 232

[56] References Cited

U.S. PATENT DOCUMENTS

| | | | |
|---|---|---|---|
| 785,019 | 3/1905 | Parker | 272/133 X |
| 3,217,840 | 11/1965 | Holkesvick | 272/133 X |
| 3,510,132 | 5/1970 | Holkesvick | 272/133 |
| 3,656,745 | 4/1972 | Holkesvick | 272/133 |
| 3,782,722 | 1/1974 | Webb | 272/133 |

*Primary Examiner*—Richard J. Apley
*Assistant Examiner*—William R. Browne
*Attorney, Agent, or Firm*—Lester J. Savit

[57] ABSTRACT

A variable resistance exercising device is described for executing isometric, isotonic and isokinetic exercises. The device includes a unitary, open-ended mandrel or bar which is shaped to define at least one shaft which is adapted to receive several turns of rope thereon, an open support loop for the rope situated near one end of the shaft, and an open guide loop at the other end of the shaft for holding the rope in proper engagement with the shaft. By virtue of the mandrel's open-ended construction, the rope may be easily engaged or disengaged from the device, and the resistance provided by the device may be changed quickly.

3 Claims, 3 Drawing Figures

ADJUSTABLE RESISTANCE EXERCISING DEVICE

BACKGROUND OF THE INVENTION

The present invention relates generally to physical exercising devices and, more particularly, to an adjustable resistance exercising device for use by athletes in performing isometric, isotonic, and isokinetic exercises, either independently or in combination.

Professional and amateur athletes frequently perform various exercises in an effort to increase their physical strength and endurance or to maintain a desired level of conditioning. Exercising devices such as bar bells, universal sets, nautilus equipment, and the like have been used by these athletes as an aid in building strength. However, such exercising devices are costly, require a great deal of permanent space, and are not easily transferred from one space to another space. Moreover, these devices are limited in that only one particular exercise can normally be performed at a time. Weights must be changed or equipment adjusted before the next exercise can be executed.

Less expensive exercise devices have been developed which rely on friction between a rope which the user pulls on and a shaft or the like around which the rope is wound. The friction or resistance developed by devices of this character is said to be "accommodating"—that is, at any given time through any given contraction the amount of resistance provided can be controlled by the individual operating the exerciser. Hence, various types of exercises can be performed with such a device.

Despite the lower cost of conventional friction-pulling type exercisers, they do have certain drawbacks. For example, some have multiple components, thereby increasing manufacturing costs and decreasing reliability. Others, such as those illustrated in U.S. Pat. Nos. 3,197,204, 3,411,766, and 3,717,339, carry a rope wrapped around a shaft which is enclosed by a housing, thereby making it somewhat difficult to vary the number of turns the rope takes around the shaft.

Other friction type exercising devices, such as those shown in U.S. Pat. Nos. 3,472,510, 3,510,132, and 3,656,745, do not carry the rope without a housing, but provide one or more shafts which form part of a closed structure. To change the number of turns around the shafts, the rope must be threaded through the enclosed structure, thereby making it somewhat difficult to quickly vary the number of turns on the shafts to change the resistance provided by the device. It is also difficult to obtain a selected number of turns on one of the shafts and a different number of turns on the other shaft without carefully threading the rope around the shafts.

Still another problem occurs with devices which operate by wrapping two free ends of a rope around the same shaft. With such an arrangement, the wrappings around the shaft may overlap and cause the rope to lock when tension is applied to it.

Accordingly, it is an object of the invention to provide an improved, adjustable resistance exercising device which overcomes the above-mentioned drawbacks of conventional exercisers.

It is a more specific object of the invention to provide such an exercising device for use with a rope wherein the number of rope turns around one or more shafts may be easily and quickly changed.

It is another object of the invention to provide such an exercising device which is relatively inexpensive to manufacture and which may be used for a nonstop series of isometric, isotonic, and isokinetic exercises.

BRIEF DESCRIPTION OF THE DRAWINGS

Further objects and advantages of the invention will be apparent from the following description when read in conjunction with the accompanying drawing wherein.

SUMMARY OF THE INVENTION

The exerciser described herein includes a unitary, open-ended mandrel or bar which is shaped so that a rope may be easily engaged or disengaged from the exerciser, and so that the resistance provided by the exerciser is easily changed. Toward this end, the mandrel is contoured to define at least one elongated shaft which is adapted to receive several turns of a rope thereon. An open support loop is formed near one end of the shaft such that the rope may be extended from the shaft, over the support loop, and then downwardly toward the opposite end of the shaft. The latter end of the shaft is formed into an open guide loop for holding the rope in proper engagement with the shaft. A head portion of the mandrel, disposed near the support loop, is adapted to receive a strap or other such attachment device for coupling the mandrel to any suitable supporting member such as a door or footboard.

DESCRIPTION OF THE PREFERRED EMBODIMENT

Figure 1:
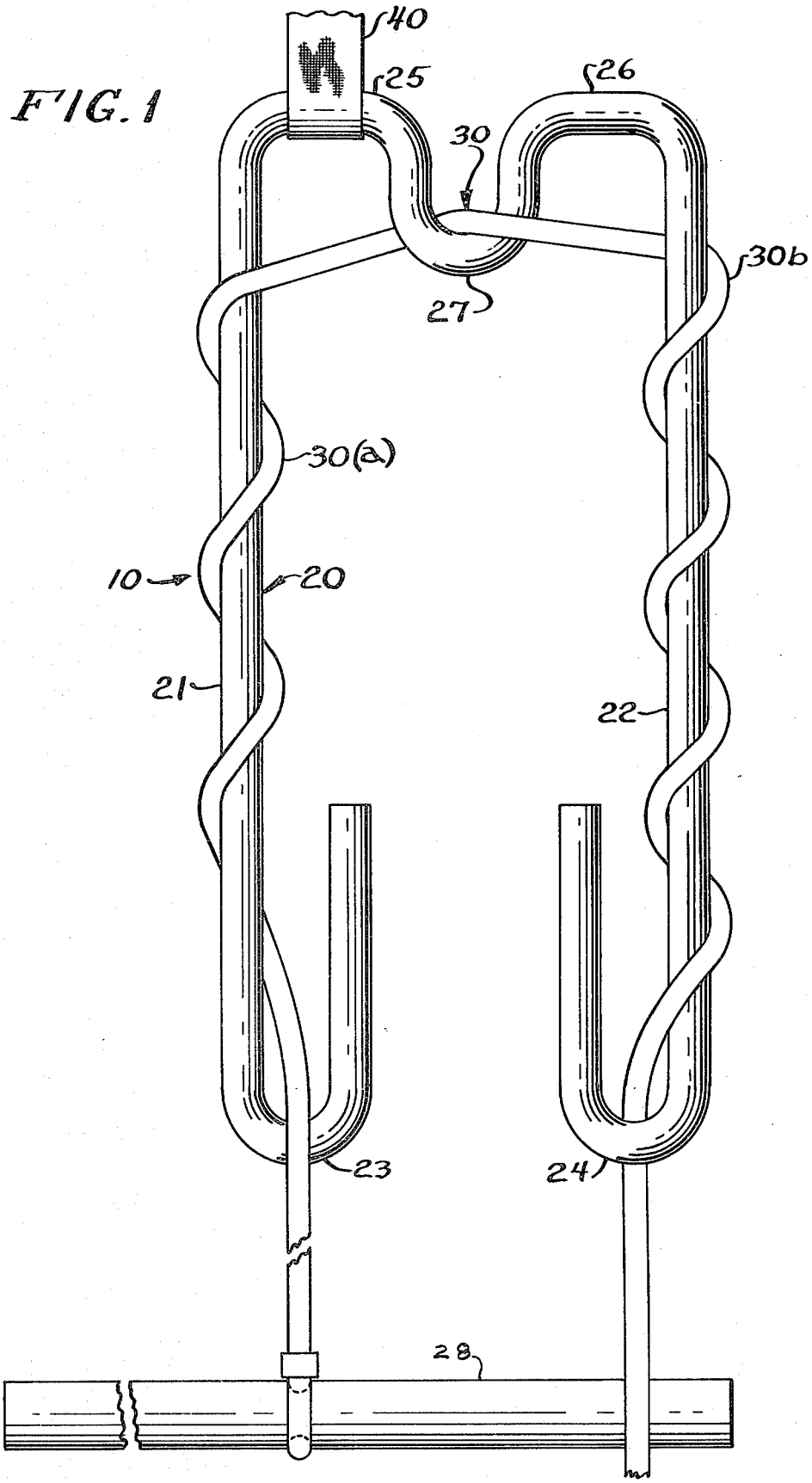
FIG. 1 is a front, elevational view of a preferred embodiment of an adjustable resistance exercising device constructed in accordance with the invention.

Referring first to FIG. 1, the numeral 10 generally indicates the preferred embodiment of an adjustable resistance exercising device. The device includes a rod or mandrel 20, a length of rope 30, and a strap 40. When the device 10 is in use, the strap 40 is attached to a footboard, door, or some other suitable support.

The mandrel 20 is bent or shaped into a configuration which defines elongated shafts 21 and 22 which are adapted to receive several turns of rope, and open-ended guide loops 23 and 24 which extend from the lower ends of shafts 21 and 22, respectively. The upper ends of shafts 21 and 22 extend into shoulder portions 25 and 26, respectively. These shoulder portions are connected by a half-circle bend 27 which forms an open support loop for the rope.

Because of the mandrel's open-ended configuration, the rope 30 is easily and quickly positioned on the shafts by first laying the center section of the rope over the support loop 27. Then the rope ends 30*a* and 30*b* which extend from the support loop are wrapped around the shafts 21 and 22, respectively, as shown. Thereafter, rope ends 30*a* and 30*b* are led through the open-ended guide loops 23 and 24 to hold the rope in its proper position on the shafts.

At this juncture it should be noted that the rope turns may wrap clockwise or counterclockwise around the shafts 21 and 22. It is preferred, however, that the rope extend from the support loop 27 such that it passes under the shoulders 25 and 26, as shown, and then wraps counterclockwise around shaft 22 and clockwise around shaft 21. In this manner, the rope is precluded from slipping over the shoulders 25 and 26, even when the mandrel is in an inverted position.

To aid in manipulating the exercising device, a handle 28 is preferably fixed to one end of the rope in the manner illustrated. If desired, another such handle may be fixed to the other end of the rope.

Preferably, the strap 40 is positioned on a shoulder portion of the mandrel which is directly above the end of the rope which the user will pull. For example, where the handle 28 is fixed to the rope end 30*a*, the strap 40 will be attached to the shoulder 25. The other end of the strap will be attached to a suitable support such as a door. Consequently, when a user pulls on the handle, stress is provided along the shaft 21 and the strap 40, thereby providing oppositely directed forces on the mandrel to virtually preclude it from being bent while in use.

Isometric, isotonic, and isokinetic contractions can be performed by using the exercising device in the following manner. Isometric contractions are effected by pulling on the handle 28 in a direction away from the position of the strap 40 and, at the same time, holding rope end 30*b* against the handle 28 with fingertip pressure. Only moderate pressure by the user is required to render the handle 28 immovable against the base resistance of the exercising device. This base resistance is a function of the number of turns on the shafts 21 and 22 and the fingertip pressure applied to the free end 30*b* of the rope. Therefore, the base resistance can be adjusted by simply changing the pressure of the operator's fingertip which holds the rope against the handle 28.

By completely releasing the pressure on rope end 30*b* and simultaneously pulling on the handle 28, a full isotonic contraction is made in approximately six seconds. Alternatively, by slowly releasing the rope end 30*b* with the control finger and pulling on handle 28, isokinetic contractions are made.

The base resistance can also be adjusted by simply adding or removing one or more of the wrapped turns on either or both shafts 21 and 22. The open-ended loops 23 and 24 permit the user to make such an adjustment easily and quickly. For example, the base resistance is increased by wrapping the rope end 30*a* an additional turn around the shaft 21 and returning that end of the rope over the loop 23. Conversely, the base resistance is decreased by removing a wrapped turn from shafts 21 or 22. The user simply lifts the rope end 30*b*, for example, out of the loop 24, removes a turn from the shaft 22, and passes the end of the rope back through the loop 24. As can be ssen, the rope need not be threaded through the mandrel each time the number of rope turns is changed.

In construction, the mandrel 10 and the other mandrels described below are preferably made of stainless steel to provide the desired degree of durability. Each mandrel is circular in cross-section and is bent or otherwise shaped to provide smooth curves as shown in FIG. 1. Thus, any part of the mandrel over which the rope passes provides resistance without the drag or chaffing which may occur with sharp corners.

The mandrel 10 has a preferred diameter of three-eighths of an inch, but the diameter may vary from about three-sixteenths of an inch to about one-half inch. The rope used with the mandrel is preferably made of nylon and has a diameter of one-quarter inch. This construction permits a resistance of up to one thousand pounds to be developed when the mandrel is supported from a suitable object.

Figure 2:
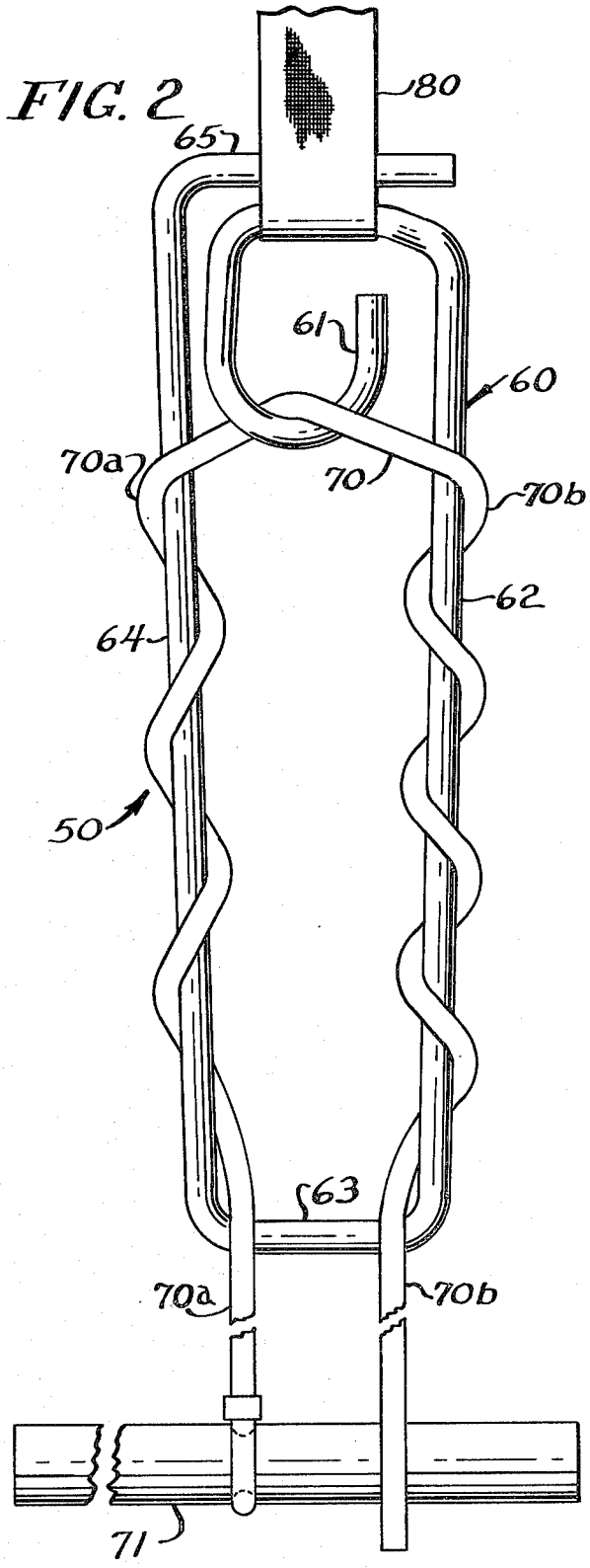
FIG. 2 is a front, elevational view of another embodiment of the exercising device.

Referring to FIG. 2, an alternate adjustable resistance exercising device 50 is shown which operates similarly to the previously described device. The device 50 includes a rod or mandrel 60 for use with a rope 70 and a strap 80.

The mandrel 60 is bent or shaped into a configuration which defines an open-ended support loop 61 which extends from the upper end of shaft 62, a horizontal guide bar 63 which joins the shaft 62 to another shaft 64, and an end portion 65 which extends from the upper end of the shaft 64 and overlies the loop 61.

Rope 70 is easily and quickly positioned on the mandrel 60 by passing the rope through the opening in the loop 61, wrapping a selected number of turns in either direction around the shafts 62 and 64, and extending rope ends 70*a* and 70*b* over the horixontal guide bar 63. A handle 71 is preferably attached to the rope end 70*a* as shown. Although not illustrated in FIG. 2, it is understood that a handle may also be attached to the rope end 70*b*.

The strap 80 passes over the member 65, through the loop 61 and attaches to a suitable supporting member such as a footboard or a door.

Isometric, isotonic, and isokinetic exercises can be performed on the exercising device 50 in generally the same manner as performed on the device shown in FIG. 1. Isometric contractions are effected by pulling on handle 71 in a direction away from the strap 80 and simultaneously holding rope end 70*b* against the handle 71 with fingertip pressure. By completely releasing the pressure on rope end 70*b* and simultaneously pulling on the handle 71, isotonic contractions are effected. Alternatively, isokinetic contractions are effected by slowing releasing the pressure on rope end 70*b* and simultaneously pulling on the handle 71.

The base resistance of the exerciser is adjusted by adding or removing one or more wrapped turns on one or both shafts 62 and 64. As with the device of FIG. 1, arranging the rope on the mandrel, removing the rope from the mandrel, and changing the number of rope turns on the shafts is accomplished easily because the loop 61 is open and the guide bar 63 permits the number of turns to be changed without the need for rethreading the rope through the mandrel.

Figure 3:
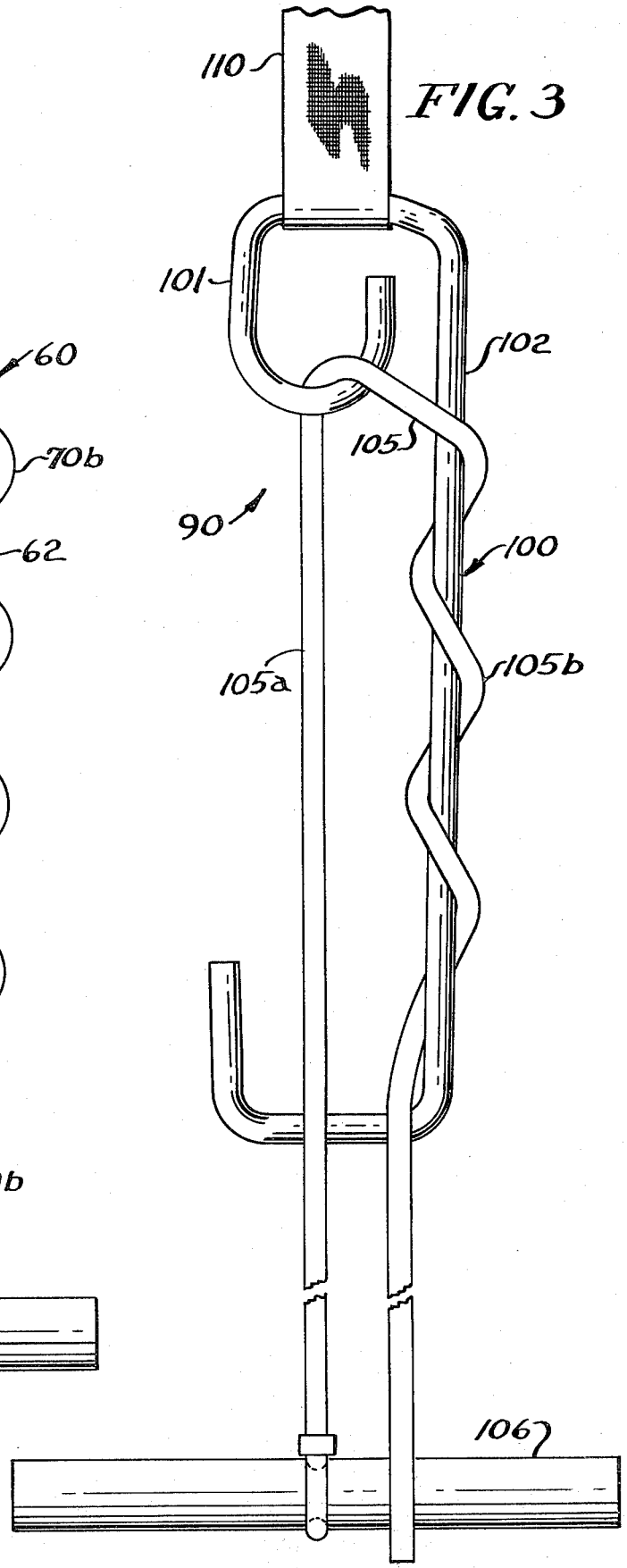
FIG. 3 is a front, elevational view of a third embodiment of the exercising device.

Another open-ended adjustable exercise device 90, as illustrated by FIG. 3, operates in a similar manner to the previously described devices except that the device 90 has only one shaft for receiving the wrapped turns of a rope. As shown, the device 90 includes a mandrel 100 for use with a length of rope 105, and a strap 110.

The mandrel 100 is bent or shaped into a configuration having an open-ended support loop 101, a shaft 102 extending downwardly from the loop 101, and a generally U-shaped, open-ended guide bar 103. In this embodiment, the guide bar 103 is situated on the same side of the shaft 102 as the loop 101, and the opening in the guide bar faces the support loop 101. With this arrangement, the rope 105 is easily and quickly positioned on the mandrel by placing the rope in the loop 101, wrapping the end 105*b* of the rope around the shaft 100 and extending it over the bar 103, and extending end 105*a* of the rope over the guide bar as shown. A handle 106 is preferably attached to the rope end 105*a*, and, although not shown by FIG. 3, it is understood that a handle may also be attached to rope end 105*b*.

The strap 110 passes through the loop 101 for attaching the mandrel to any suitable supporting member.

Isometric, isotonic, and isokinetic contractions are generated by using the fitness device 90 in the following manner. Isometric contractions are made by pulling on the handle 106 in a direction opposite to or away from the strap 110 and by simultaneously holding rope end **105*b* against the handle 106 with fingertip pressure. Isotonic contractions are effected by releasing the rope end 105*b* while pulling on the handle 106. Alternatively, isokinetic contractions are made by initially holding rope end 105*b* against the handle 106 with fingertip pressure, and then slowly releasing the fingertip pressure while pulling on the handle 106. The base resistance of the device is adjusted by adding or removing one or more wrapped turns on shaft 102**.

From the foregoing description, it will be appreciated that the open-ended nature of the illustrated exercisers renders them easy to use. When the resistance is to be changed, the number of rope turns around the shafts is easily varied without the need for rethreading the rope.

Another advantage of the illustrated devices is their simplicity of construction. The mandrels require no welds and are easily shaped from a single bar using known techniques. Hence, construction costs are decreased and durability is increased.

Although the invention has been described in terms of specific embodiments, it will be obvious to those skilled in the art that many alterations and modifications may be made without departing from the invention. Accordingly, it is intended that all such alterations and modifications be considered as within the spirit and scope of the invention as defined by the appended claims.

What is claimed is:

1. An adjustable friction resistance exercising device comprising:

a unitary mandrel contoured to define:

first and second elongated shafts having upper ends and lower ends and adapted to receive several turns of rope thereon;

a head portion joined to the upper ends of the shafts so as to space the shafts apart from each other, the head portion being contoured to define a first shoulder joined to the first shaft, a second shoulder joined to the second shaft, and a U-shaped support loop between the shoulders so that a rope may be supported by the support loop and threaded under each shoulder and then around the shafts to hold a rope on the mandrel;

a first U-shaped open ended guide loop means joined to the lower end of the first shaft and having an opening which faces the head portion and which is situated between the shafts;

a second U-shaped open ended guide loop means joined to the lower end of the second shaft and having an opening which faces the head portion and which is situated between the shafts, wherein the first and second guide loop means are laterally spaced apart from one another so that a rope may pass unopposed between them, whereby a rope may be laid on the support loope such that one end of a rope may be wrapped around the first shaft and extended over the first guide loop means, and the other end of a rope may be wrapped around the second shaft and extended through the second guide loop means; and attachment means for joining the first shoulder to a supporting member.

2. An adjustable friction resistance exercising device comprising:

a unitary mandrel contoured to define:

a pair of elongated shafts adapted to receive several turns of rope thereon;

support loop means disposed near one end of the shafts for receiving a rope extending from one shaft to the other shaft;

shoulder means joining the shafts to the support loop means and defining a head portion;

attachment means connected to the head portion for attaching the mandrel to a supporting member;

An open ended guide loop means connected to the respective end of each shaft opposite the support loop means, wherein the open ended guide loop means are laterally spaced from one another such that a rope may pass unopposed between them; and whereby the number of turns of a rope and the friction on the shafts maybe quickly and easily changed by passing a rope between the laterally spaced guide loop means.

3. The exercising device of claim 2 further comprising:

a rope extending through the support loop means and around the shafts, the rope extending away from the mandrel through the guide loop means.

* * * * *